US005722489A

United States Patent [19]

Lambe et al.

[11] Patent Number: 5,722,489

[45] Date of Patent: Mar. 3, 1998

[54] MULTIPURPOSE DRILLING TOOL

[76] Inventors: Steven S. Lambe, 715 L St. Suite 400, Anchorage, Ak. 99501; Matt W. Mahaffey, 8620 N. New Braunfels, San Antonio, Tex. 78217

[21] Appl. No.: 629,392

[22] Filed: Apr. 8, 1996

[51] Int. Cl.[6] ..... E21B 10/66

[52] U.S. Cl. ..... 166/269

[58] Field of Search ..... 175/267, 269, 175/292

[56] References Cited

U.S. PATENT DOCUMENTS

| | | | |
|---|---|---|---|
| 3,406,769 | 10/1968 | Kammerer, Jr. | 175/269 |
| 3,712,854 | 1/1973 | Thometz et al. | 175/269 |
| 5,111,893 | 5/1992 | Kuello-Aune | 175/269 X |
| 5,141,063 | 8/1992 | Quesenbury | 175/267 |

FOREIGN PATENT DOCUMENTS

| | | | |
|---|---|---|---|
| 1758065 | 12/1970 | Germany | 175/269 |
| 1756526 | 8/1992 | U.S.S.R. | 175/269 |

*Primary Examiner*—William P. Neuder

*Attorney, Agent, or Firm*—Peter A. Borsari; Eric W. Trucksess

[57] ABSTRACT

The present invention relates to a multipurpose drilling tool that may be cycled between drilling and underreaming operations while situated in a well bore. More specifically, the present invention provides a multi-purpose tool in the form of a housing member comprising a central bore, four extensible underreaming blades and means for attaching a standard drill bit. The ability of the multipurpose drilling tool to cycle between drilling and underreaming modes is provided by means of a piston which is motivated downwardly and rotationally by fluid pressure and is directed by a piston travel guide from a first relaxed position to either a drilling position or an underreaming position. The present invention enables cycling of the tool within the well bore without requiring the removal of the tool and drilling string from a well bore, thus increasing the efficiency of drilling operations.

20 Claims, 5 Drawing Sheets

MULTIPURPOSE DRILLING TOOL

FIELD OF INVENTION

The present invention relates to a multipurpose drilling tool that may be cycled between drilling and underreaming operations while situated in a well bore. The inventive drilling tool is adaptable for use in conventional rotary drilling strings and for coil tubing drilling. More specifically, the present invention provides a multi-purpose tool in the form of a housing member comprising a central bore, four extensible underreaming blades and means for attaching a standard drill bit. The ability of the multipurpose drilling tool to cycle between drilling and underreaming modes is provided by means of a piston which is motivated downwardly and rotationally by fluid pressure and is directed by a piston travel guide from a relaxed position to either a drilling position or an underreaming position. The present invention enables cycling of the tool within the well bore without requiring the removal of the tool and drilling string from a well bore, thus increasing the efficiency of drilling operations.

BACKGROUND OF THE INVENTION

As the world's petroleum resources become ever-increasingly stressed, it becomes critically more important to locate and access new reserves. Drilling operations are hampered by the relative difficulty in reaching reserves in subterranean formations and by attendant costs in equipment and manpower. Typically, a well bore is first drilled with a drill bit in conjunction with a pumped drilling fluid, after which the drill string and drill must be removed from the bore. An underreamer is then used to enlarge the bore in order to provide room for cementing operations or gravel packing. If further drilling is required, the underreamer first must be removed from the drill string, the drill reinstalled and the cycle of drilling and underreaming is repeated. The inefficiency in such a drilling regimen created by the need to remove and to replace the desired down hole tool raises attendant drilling costs and expends valuable time.

Although many attempts have been made to combine drilling bits with underreamers, a multipurpose drilling tool capable of cycling between the drilling and underreaming operations without removal of the tool from the drill string has not been developed. For example, U.S. Pat. No. 5,139,098, issued Aug. 18, 1992 to J. Blake discloses a combined drill and underreaming tool which utilizes a piston under fluid may be used to extend underreaming blades outwardly from a cylindrical body member. While Blake provides means in the form of a dart to mediate the cessation of drilling operations and the initiation of underreaming operations, he does not provide any mechanism for cycling back to a drilling mode.

U.S. Pat. No. 2,690,897, issued Oct. 5, 1954 to R. E. Clark, Jr. discloses a combination mill and underreamer tool that is attachable to a drill string. Clark, Jr. teaches the use of a plunger that may be dropped down the bore of the drill string to direct the deployment of both milling cutters and underreaming blades. Fluid pressure drives the downward passage of the plunger to sequentially activate the mill and underreamer. However, the activation of the mill and underreamer tools severs shear pins which are used to hold the tools in initial positions. As a result, a second cycle of milling and underreaming requires the removal of the tool and the insertion of new shear pins.

U.S. Pat. Nos. 5,090,480, issued Feb. 25, 1992 and 5,036,921, issued Aug. 6, 1991 both the F. J. Pittard et at. relate to underreaming tools having simultaneously expandable and sequentially expandable cutter blades, respectively. Pittard et al. employ a piston assembly receiving pressure from a pumped drilling fluid is used to expand the cutter blades and a small portion of the continuous stream of fluid flowing through the drill string may be directed to provide clean the cutter blades. Drill bits may be screwed onto the tools so that simultaneous drilling and underreaming are possible. However, Pittard et al. appear to contemplate neither a separate drilling operation in the absence of underreaming by the design of their tool nor a cycling between drilling and underreaming operations.

U.S. Pat. No. 4,562,252, issued Jan. 21, 1986 to T. R. Campbell et al. relates to an underreamer having three expandable arms equidistantly and circumferentially mounted about the central axis of the tool and having longitudinally extending bores to permit fluid from a drill string to be directed along the arms when underreaming. Each of the arms is hingedly attached and driven from inactive positions to active, expanded positions by a piston. The underreamer is capable of enlarging an previously drilled bore.

U.S. Pat. No. 1,804,850, issued May 12, 1931 to J. B. Triplett; U.S. Pat. No. 1,834,335, issued Dec. 1, 1931 to R. Crum; U.S. Pat. No. 3,171,502, issued Mar. 2, 1965 to A. W. Kammerer; U.S. Pat. No. 4,589,504, issued May 20, 1986 to N. A. A. Simpson and U.S. Pat. No. 4,821,817, issued Apr. 18, 1989 to A. Cendre disclose underreaming tools that utilize the pressure exerted by a pumped drilling fluid to deploy underreaming apparatuses.

Despite the teachings of the prior art, a need still exists for a tool which may be cycled between drilling and underreaming operations while in situ within a well bore. Such a device should provide means for continuous operation and repeated cyclings. Such a device also should also provide means by which a surface user may determine which operational mode is being utilized.

SUMMARY OF THE INVENTION

Accordingly, it is an object of the present invention to provide a multi-purpose tool having means to cycle between drilling and underreaming operational modes for both cased and open hole applications.

It is another object of the present invention to provide a multi-purpose tool which utilizes changes in the pressure exerted by a pumped drilling fluid to effect the cycling between operation modes.

It is an additional object of the present invention to provide a multi-purpose tool that utilizes diverted streams of a pumped drilling fluid to effect self-cleaning and self-cooling.

It is a further object of the present invention to provide a multi-purpose tool that has interchangeable parts so that said tool may be modified to permit drilling with different drilling fluids in varied substrates.

It is a still further object of the present invention to provide a multi-purpose tool which is economical to manufacture, durable in construction and effective in operation.

These and other objects of the present invention, as embodied and broadly described herein, are achieved by provided a multi-purpose tool in the form of a hollow housing member fitted with four extensible underreaming blades and attachment means for a conventional drill bit. A hollow position having a central bore and numerous ancillary ports is disposed within the central bore of the housing member. The piston conducts and directs fluid through the central bore of the housing member and is motivated by the interaction of fluid pressure and a compressible spring. Means are provided in the form of a piston travel guide to direct the movement of the piston within the central bore from a relaxed position to either a drilling position or an underreaming position. In this manner, the multipurpose tool of the present invention may be cycled repeatedly between drilling and underreaming operational modes.

Additional objects, advantages and novel features of the present invention will be set forth in part in the description which follows and in part will become apparent to those skilled in the art upon examination of the following specification or may be learned by practice of the invention. To the accomplishment of the above-related objects, this invention may be embodied in the forms illustrated in the accompanying drawings, attention being called to the fact, however, that the drawings merely are illustrative, and that changes may be made in the specific construction illustrated and described within the scope of the appended claims.

BRIEF DESCRIPTION OF THE DRAWINGS

The present invention will be better understood with reference to the appended drawing sheets, wherein.

DETAILED DESCRIPTION

It will be appreciated that the present invention can take many forms and embodiments. Some embodiments of the invention are described so as to provide an understanding of the invention. It is not intended that the illustrative embodiments described herein should limit the invention in any manner.

The present invention relates to a multipurpose drilling tool in the form of a substantially cylindrical housing member 50 comprising a central bore 40, four extensible underreaming blades, means for attaching a standard drill bit and a piston 12 disposed within said central bore of said housing member. As described more fully hereinbelow, motivation of piston 12 within the central bore is caused by the interaction between fluid pressure acting as a downward force on the piston and a compressible spring acting as an upward force on the piston. A piston travel guide provides the necessary means for cycling the piston from a relaxed position to either a drilling position or an underreaming position.

Figure 1:
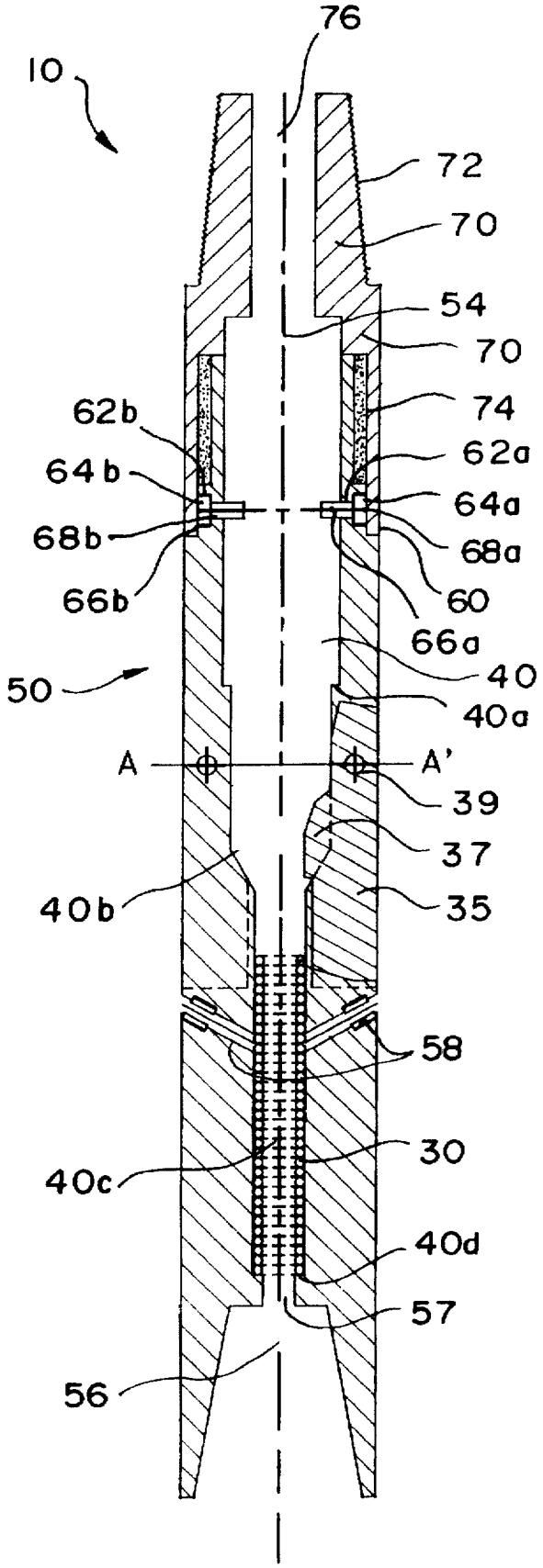
FIG. 1 is a cross sectional side view of the housing member of the present invention.

Referring to the drawings, in particular FIG. 1, the multipurpose drilling tool 10 comprises a housing member 50 in the form of an elongate, generally cylindrical shell having an externally threaded upper inlet end 54, a lower outlet end 56 distal thereto and a central bore 40 disposed within said housing and connecting said inlet and outlet ends. Toward the outlet end 56 of the housing member 50, four circumferentially spaced circular tattle tale ports 58 penetrate the wall of the housing member at right angles to each other and in an upwardly directed angle. The housing member 50 may be constructed from any suitable hard metal or metal alloy. As discussed hereinafter, it is to be understood that the term "tattle tale" with reference to tattle tale ports 58, refers to a pressure differential indicator. In particular, the difference $\delta P$ between the drilling pump pressure $P^1$ through these ports 58 and the pump $P^2$ measured when the underreaming blades are fully opened is termed the "tattle tale", indicating that the underreaming blades have fully opened.

As shown in FIG. 1, the central bore 40 is configured with differing diameters along its length and generally is wider at the inlet end 54 than at the outlet end 56. From the inlet end 54, a first narrowing of the bore 40 occurs in stepwise fashion at **40*a* followed by a tapered narrowing at 40*b* into a lower bore segment 40*c* hereinafter referred to as the lower bore, while the section of the central bore above said lower bore is hereinafter referred to as the upper bore. With said lower bore, a compressible spring 30 is disposed, said spring being retained by a stepwise narrowing of the lower bore at 40*d*. The tattle tale ports 58 are in fluid communication with the lower bore 40*c* and provide an alternate outlet route to a fluid pumped through the tool. The central bore 40 terminates into a constricted outlet 57 in the outlet end 56 of the housing member 50. Outlet end 56** is provided with any suitable means well known in the art for securing a conventional drill bit.

Below the inlet end 54 of the housing member 50 and above a service break 60, the housing member narrows. In this region, a pair of circumferentially spaced piston hold down screws **64*a* and 64*b* having heads 66*a* and 66*b* and ends 68*a* and 68*b* respectively. The piston hold down screws threadingly engage threaded recesses 62*a* and 62*b* from the exterior of the housing member through to the interior, said heads being are flush with or even slightly recessed into the exterior surface of the housing member 50, while said project inwardly into the central bore 40** to a desired predetermined depth.

An inlet sub 70 comprises an externally-threaded top section 72 having a generally frustoconical cross section and an integral, internally-threaded cylindrical depending wall 74. The inlet sub 70 is shown attached to the inlet end 54 of the housing member 50. The externally-threaded top section 72 provides means for attaching the tool 10 to a drill string for use with conventional rotary drilling rigs or to coil tubing for use with coil tubing drill rigs. The internally threaded cylindrical depending wall 74 matingly engages the externally threaded inlet end 54, thereby covering the piston hold down screws **64*a* and 64*b* and protecting the inlet end 54. A bore 76 through the inlet sub 70 joins the central bore 40, extending the fluid path of a drill string to the tool 10**.

Figure 3:
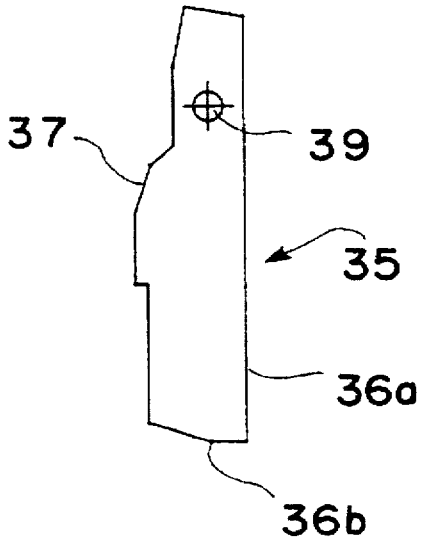
FIG. 3 is a side view of a pivotable underreaming blade of the present invention.
Figure 6:
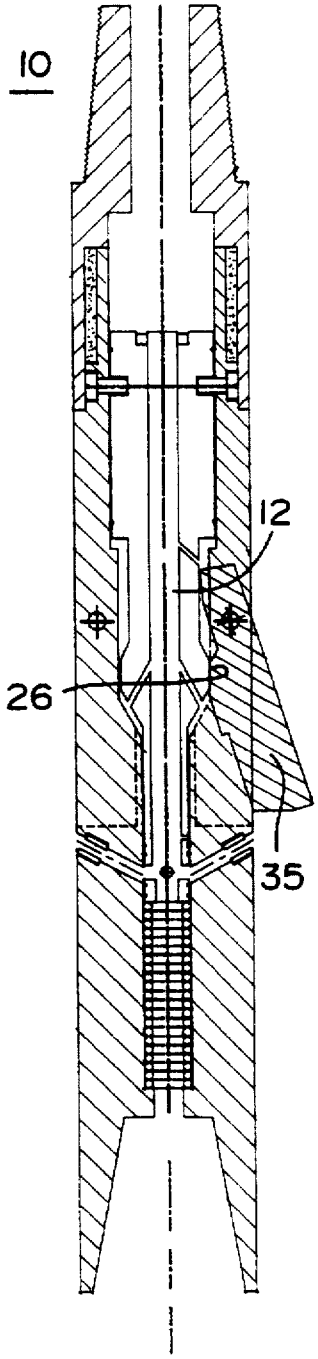
Figure 8:
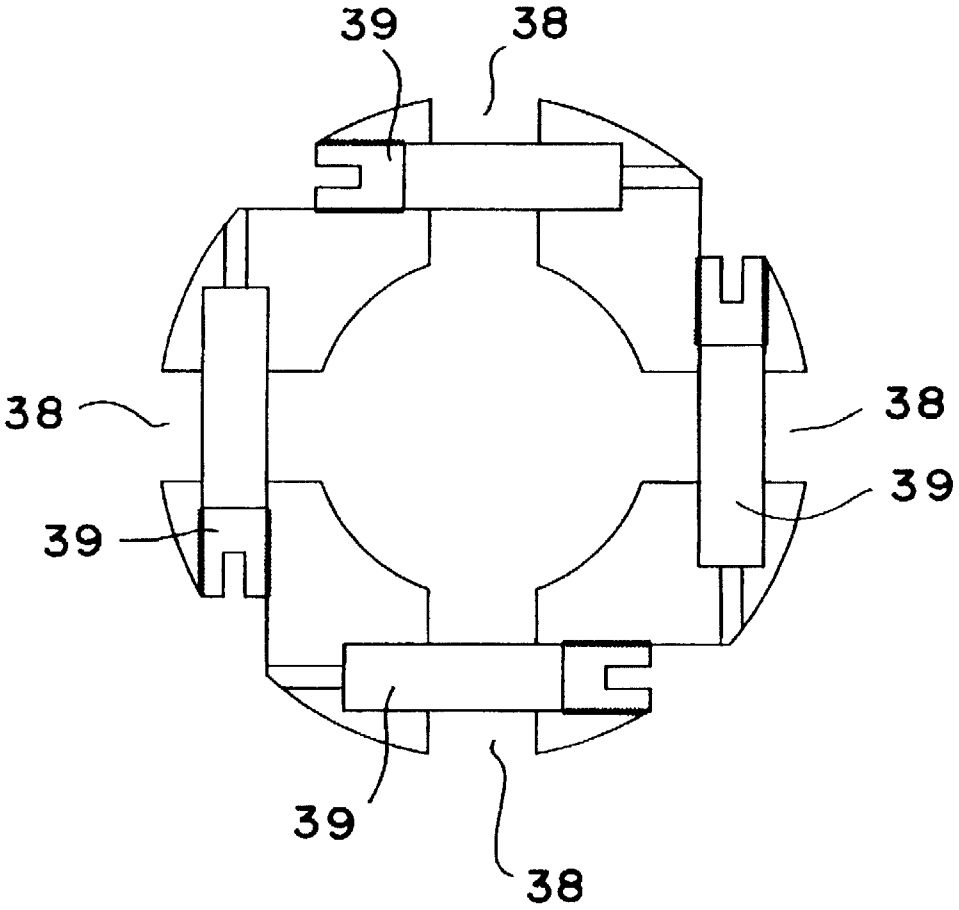
FIG. 8 is a cross sectional view taken along line A—A showing the positioning of pivot pins within the housing member.

Referring now to FIGS. 1 and 3, four circumferentially spaced underreaming blades 35 each having a blade graded land 37 are pivotally mounted to the housing member 50 by pivot pins 39 above the four respective tattle tale ports 58. In the relaxed position shown in FIG. 4, the blades are housed in blade cavities 38 and lie flush with the wall of the housing member 50. When the tool 10 is performing an underreaming operation as shown in FIG. 6, the blades are pivoted outwardly from the housing to expose cutting edges **36*a* and 36*b*. As shown in FIG. 8, four pivot pins 39 are fixedly screwed into the housing member 50 through each underreaming blade 35. The blades 35 may be made from any suitably hard metal alloy and may be dressed at the cutting edges 36***a* and 36*b* with cutting materials whose selection is determined by cost considerations and by the nature of the drilling substrate. For example, natural diamond may be chosen for drilling in hard cement, barium sulfate scale, formation fines and for open hole drilling or tubing cuts. A dressing of Kutrite[198] is suitable for drilling cement, soft scales, formation fines and for open hole drilling. PDC buttons may be used for drilling cement, all scales, formation fines and shales.

Figure 2:
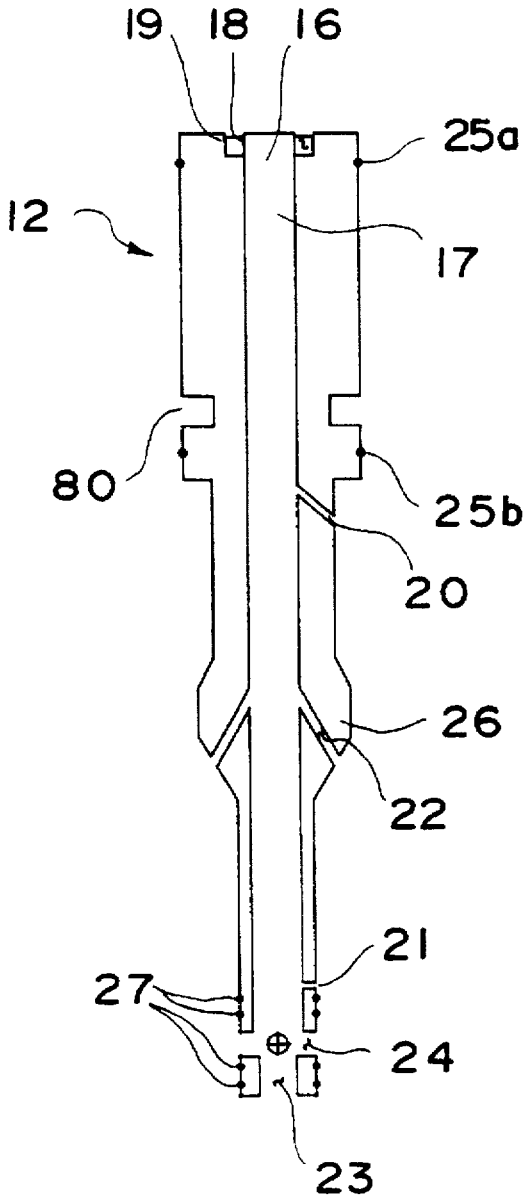
FIG. 2 is a cross sectional side view of the piston of the present invention.

As best shown in FIG. 2, the hollow piston 12 comprises a central piston bore 16 having an upper end 17 in fluid communication with a top piston orifice 18 whose diameter is variable and which may be attached to the piston by a snap ring 19. Numerous ancillary ports are in fluid communication with the piston bore 16 including an upper tool flush 20, a lower tool flush 21, four circumferentially spaced blade cleaning jets 22, a tattle tale orifice 23 and four circumferentially spaced tattle tale piston fluid ports 24. The tattle tale piston fluid ports 24 extend downwardly at an angle through a piston graded land 26. Two tattle tale O-rings 27 are located above and below the tattle tale piston fluid ports 24. The outer surface of the piston 12, between upper and lower travel piston slot seals 25*a* and 25*b*, is configured, such as by cutting or edging, with a piston travel guide 80 which interacts with the piston hold down screws 64*a* and 64*b* to cycle the piston through the central bore 40. The piston 12 is constructed from durable material, including for example, metals and metal alloys.

Figure 4:
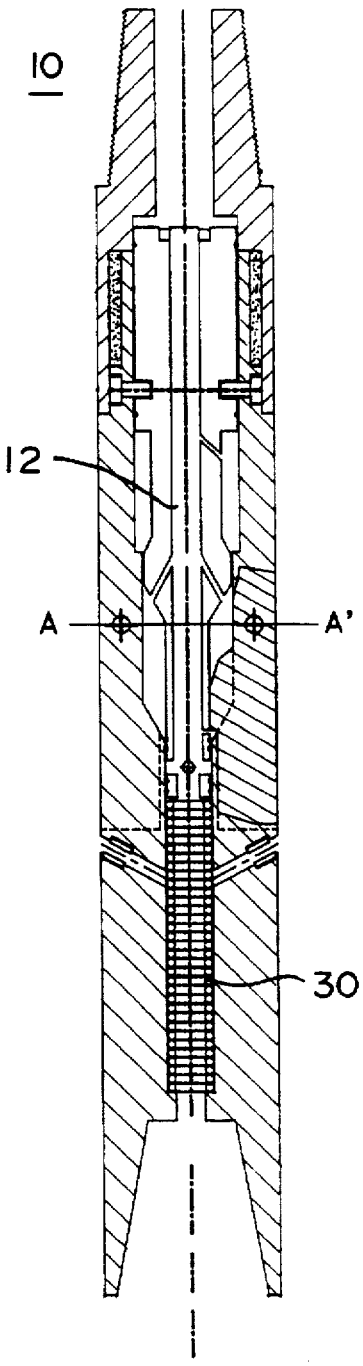
FIGS. 4, 5 and 6 are cross sectional side views of the tool of the instant invention showing the relative placement of the piston and the housing member when the tool is in a relaxed position, in a drilling position and in an underreaming position, respectively.

The function and purpose of the piston elements will be better understood by examining the interaction between the piston 12 and the housing member 50 with reference to FIGS. 4 through 7. As shown in FIG. 4, the central bore 40 of the housing member 50 is configured to receive the piston 12. By exerting an upward force, the compressible spring 30 maintains the position of the piston 12 within the bore 40, in FIG. 4, this position being a relaxed position. While the piston 12 is in the relaxed position, the tool 10 may be attached to a drill string and positioned at a desired depth within a well bore.

In operation, drilling fluid pumped under pressure through the drill string impacts the inlet orifice 18 of the piston 12. The upper and lower travel piston slot seals 25*a* and 25*b*, in contact with the wall of the central bore 40 above 40*a*, seal off the piston travel guide 80 engaged by the piston hold down screws 64. Drilling fluid pumped through the drill string passes through the inlet orifice 18 into the piston bore 16 and flows into the central bore 40 of the housing member 50 through the tattle tale orifice 23 as well as through the upper and lower tool flushes 20, 21. Passage of drilling fluid through the upper tool flush 20 prevents the entrance and accumulation of debris into the bore 40, thereby significantly reducing the risk of tool binding. The seal formed by the upper and lower travel piston slot seals 25*a* and 25*b* prevents debris and drilling fluid from entering the piston travel guide 80. Drilling fluid passing through the lower tool flush 21 prevents debris from damaging the tattle tale O-rings 27*a*. Because the diameter of the inlet orifice 18 is smaller than the bore 76 of the top sub-housing 70, conduction of drilling fluid from the drill string into the tool exerts a downward pressure on the piston 12. The passage of fluid through the ancillary piston ports alleviates some of this downward pressure such that below a threshold minimum downward pressure, an equilibrium between the inlet and outlet ends of the tool is achieved. Opposing this downward pressure, spring 30 remains essentially uncompressed below the threshold minimum pressure; however, when the pressure exceeds this threshold, the spring compresses, thereby allowing the piston to be motivated and cycled downwardly through the central bore 40.

Figure 7:
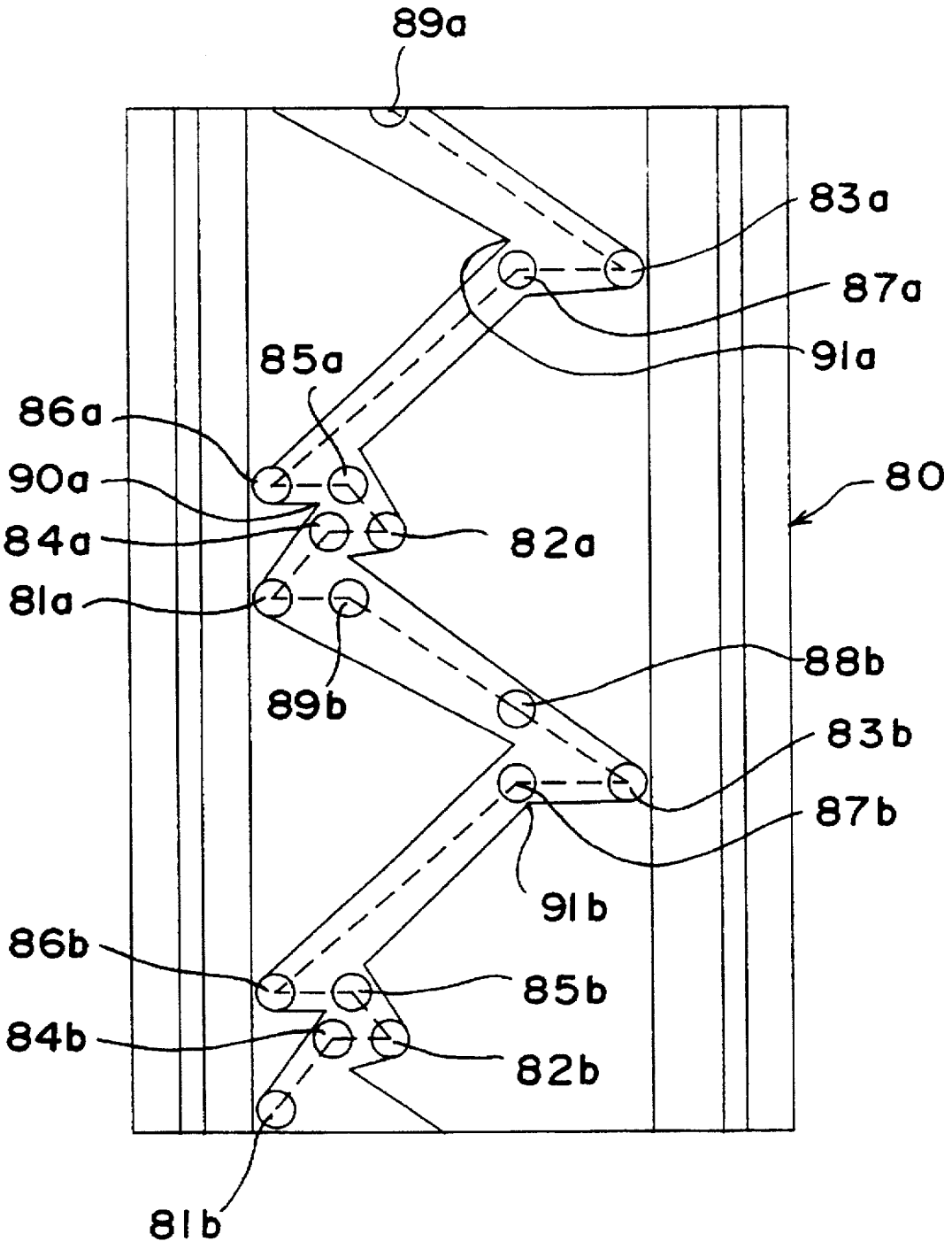
FIG. 7 is a map view of the piston travel guide having a broken line showing of the path described by the engagement of piston hold down screws with the guide.

Referring now to FIG. 7, the path of the piston 12 described by its position relative to the piston hold down screws 64 is shown in broken line. In the relaxed position, the piston hold down screws 64*a* and 64*b* engage the piston travel guide 80 in register with each other at positions 86*a,b* respectively, circumferentially spaced from each other at 180°. As the piston 12 is motivated downwardly, the engagement between the piston hold down screws 64 and the piston travel guide 80 causes the piston to move both in a rotational direction as well as in a downward direction so that the screws engage the guide along the path defined by 86*a,b* and 85*a,b*. So long as the pressure exerted on the piston 12 by the drilling fluid exceeds the upward pressure of the spring 30, the piston will continue to move downwardly until the screws 64*a* and 64*b* engage the guide 80 at 82*a,b*, this point hereinafter referred to as the drilling position.

Figure 5:
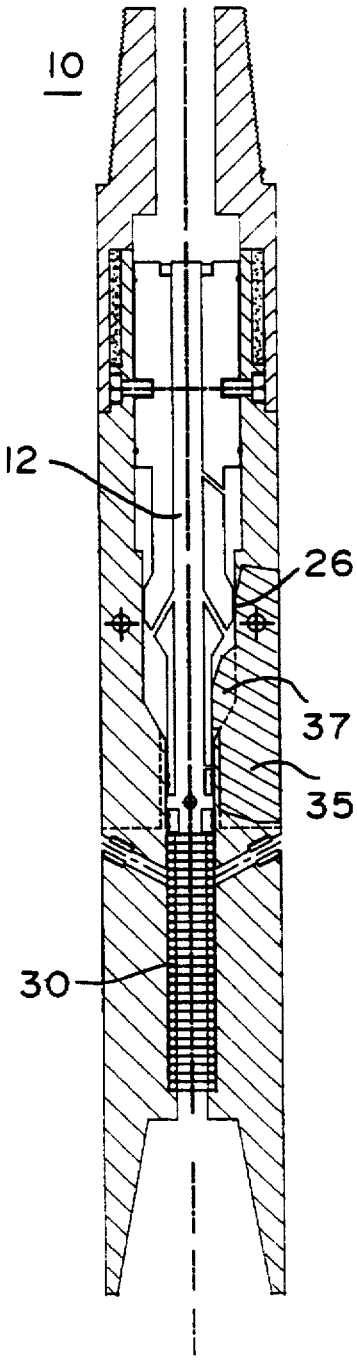

At this drilling position, best seen in FIG. 5, the underreaming blades 39 remain retracted. When the desired pumping rate is achieved at the surface, the drilling pump pressure $P^1$ is recorded and drilling operations are initiated. By maintaining the drilling pump rate above the minimum pump rate needed to effect pressure $P^1$, the piston 12 is maintained in the drilling position. Referring again to FIG. 7, the piston travel guide 80 further describes a path along the broken line joining in order 82*a,b*, 84*a,b*, 81*a,b*, 89*a,b*, 88*a,b* and 83*a,b*. When a drilling operator desires to cease drilling and to cycle the tool 10 to an underreaming phase, the pump rate is decreased below the minimum pump rate such that the pump pressure drops below $P^1$. Directed by the engagement between the piston travel guide 80 and the piston hold down screws 64*a* and 64*b*, the piston 12 is pushed upwardly by spring 30, now exerting an upward force greater than the threshold minimum pressure, said screws engaging the guide at 84*a,b* and cycling the piston back to the relaxed position, 81*a,b*.

Once the tool has been cycled back to the relaxed position, the piston 12 can be cycled to the underreaming position shown in FIG. 6 by increasing the drilling fluid pump rate, thereby increasing the downward fluid pressure acting on the piston. The increased fluid pressure causes the piston 12 to move downwardly and rotationally until the screws 64*a* and 64*b* engage the piston travel guide 80 at 83*a,b* as shown in FIG. 7. The jig in the guide at 90*a,b* prevents a backward sliding of the piston so that in cycling to the underreaming position, the piston 12 must follow a rotational path in the same direction it followed in arriving at the drilling position.

As the position approaches the underreaming position, the piston's graded land 26 contacts and exerts a pressure on blade graded lands 37 thereby causing the blades to extend outwardly from the housing member 50. In the underreaming position, the tattle tale piston fluid ports 24 become aligned with the tattle tale ports 58 and permit fluid to flow through these ports in addition to flowing through the other ancillary ports. The pump pressure $p^2$ once again is recorded and compared with the drilling pump pressure $P^1$. The difference $\delta P$ between the pressure $P^1$ and $p^2$, commonly referred to as the "tattle tale", is positive verification that the underreaming blades 35 have fully opened. During the underreaming operation, the blade cleaning jets 22 direct drilling fluid toward the blades 35, in order to prevent the blades from over-heating and to keep the blade cavities 38 free of debris.

Once the underreaming operation has been performed, the downward pressure exerted by the drilling fluid is reduced and piston hold down screws 64*a* and 64*b* engage the piston travel guide 80 along the broken line path between 83*a,b* and 87*a,b* as the upward pressure exerted by spring 30 becomes greater than the downward pressure. A second jig at 91*a,b*, similar to that at 90*a,b* ensures once again that rotational movement by the piston 12 will continue in the same direction as before. The piston 12 completes the cycle by returning along 87*a,b* to the relaxed position 86*a,b*, having rotated 180° from its starting position. Screws 64*a* and 64*b* now engage the piston travel guide 80 at positions 86*a,b* respectively. The piston 12 may be cycled again to re-initiate drilling and underreaming as required, or the tool 10 with the piston 12 in the relaxed position may be removed from the well bore. To promote smooth movement of the piston 12, the piston travel guide 80 may be coated with Teflon[198] or any other suitable material as is known to those skilled in the art.

The following nonlimiting example is presented to further illustrate the present invention:

EXAMPLE

A multi-purpose drilling tool 10 with a total housing member 50 diameter of 3" is fitted with a top sub-housing 70 having a 1" diameter bore 76 through an externally-threaded top section 72. The integral, internally-threaded cylindrical depending wall 74 extends downwardly 3.5" over the externally-threaded, narrow inlet end 54 of the housing member 50 to a service break 60. The depending wall 74 covers the heads 66*a,b* of two circumferentially spaced piston hold down screws 64*a,b* having a diameter width of 0.25" and a shear strength of 8,400 lbs. positioned 2.5" below the inlet end 54. The ends 68*a,b* of the screws 64*a,b* extend 0.3" into the central bore 40 of the housing member 50. Above the first narrowing at 40*a*, the central bore diameter 40 is 1.8", then narrows to 1.55" in stepwise fashion 5.75" below the screws 64*a,b*. A tapered narrowing 40*b* 2.6" below 40*a* results in reducing lower bore 40*c* to 0.8" in diameter. A 5.0" long compressible spring disposed in the lower bore 40*c* is retained therein by a stepwise narrowing at 40*d* to a 0.5" diameter. Four 0.1875" diameter circular, circumferentially-spaced tattle tale ports 58 are in fluid communication with the lower bore 40*c* 3" below the tapered narrowing 40*b*.

Four circumferentially spaced underreaming blades 35 are pivotally mounted to the housing member 50 by 0.30" pivot pins 39 1.25" below the first narrowing 40*a*. Each blade 35 is approximately 0.45" thick and 4.25" long. When in the underreaming position, the blades 35 may be deflected outwardly from the housing member 50 so that the blades can cut a circular path having a 5" diameter.

The hollow piston 12 is 9.75" in length having a piston bore 16 diameter of 0.50". The interchangeable top piston orifice 18 may be selected to have the same diameter. The upper end 17 of the piston 12 is received into the central bore 40 above 40*a* and is provided with a diameter width of slightly less than 1.8" to allow room for encircling upper and lower travel piston slot seals 25*a,b*. A piston travel guide 80 is cut 0.3" into the outer surface of the piston and has a slot width slightly wider than the diameter of the piston hold down screws 64*a,b*. To accommodate the narrowings of the central bore 40, piston diameter width is reduced to 1.2" and finally to 0.750". Suitable tattle tale O-rings 27*a,b* seal the piston and central bore 40 areas about four 0.25" diameter circumferentially spaced tattle tale piston fluid ports 24. Both upper and lower tool flushes 20, 21 merge into the bore 16 and have 0.0625" diameters. Between the tool flushes 20, 21, four blade cleaning jets 22 having 0.09375" diameters are circumferentially spaced beneath respective underreaming blades 35.

The multi-purpose tool as described above exhibits the following characteristics in operation with a surface injection rate of 105 gallons per minute. In the drilling position, 24.5 gpm are passed by the upper tool flush 20, the lower tool flush 21 and the blade cleaning jets 22, whereas 80.5 gpm are passed by the tool 10 to a drilling bit for a drilling pressure $P^1$ of 411 psi. In the underreaming position, 2.5 gpm are passed by upper and lower tool flushes 20, 21; 11.5 gpm are passed through the blade cleaning jets 22; 46.5 gpm are passed through the tattle tale piston fluid ports 24 and tattle tale ports 58.; and 45 gpm are passed through the tool 10 to the drilling bit 100. The underreaming pressure $p^2$ is 136 psi so that the differential pressure $\delta P$ of the tattle tale is 275 psi ($P^1$ minus $p^2$). This drop in pressure is the positive indication that the tool has completely opened for underreaming.

What is claimed is:

1. A multipurpose drilling tool comprising:

a housing member comprising an upper inlet end, a lower outlet end, a central bore having at least an upper section and a lower section disposed within said housing and connecting said inlet end and outlet end, and a plurality of tattle tale ports for indicating the pressure differential $\delta P$ between differing pump pressures through said tattle tale ports;

a hollow piston disposed within said upper section of said central bore, said piston having a piston graded land, a central piston bore having an upper end and a plurality of ancillary ports;

a compressible spring disposed within said lower section of said central bore and exerting an upward force on said piston;

a plurality of underreaming blades pivotally mounted to said housing member each of said blades comprising at least one cutting surface and a blade graded land configured in such a manner that said blades pivot outwardly from said housing member upon contact with said graded piston land;

a piston travel guide for controlling the cycling of said piston through said central bore in such a manner as to cycle the piston to either a drilling position or an underreamining position;

means for attaching a drill bit to said housing member; and means for attaching said housing member to a drill string.

2. The multipurpose drilling tool in accordance with claim 1, wherein said hollow piston has an outer surface which is configured in such a manner that it interacts with said piston travel guide through two piston hold down screws, said screws being fixedly mounted within said housing and projecting into said central bore to engage said piston travel guide.

3. The multipurpose drilling tool in accordance with claim 2, wherein said piston travel guide is cut or etched into the outer surface of said piston.

4. The multipurpose drilling tool in accordance with claim 1, wherein said upper end of said central piston bore is in fluid communication with a top piston orifice and said plurality of ancillary ports include an upper tool flush, a lower tool flush, four circumferentially spaced blade cleaning jets, a tattle tale orifice and four circumferentially spaced tattle tale piston fluid ports.

5. The multipurpose drilling tool in accordance with claim 1, wherein the introduction of drilling fluid into the upper inlet end of said housing member exerts a downward force on said piston.

6. The multipurpose drilling tool in accordance with claim 5, wherein the introduction of drilling fluid into the upper inlet end of said housing member exerts a downward force on said piston in excess of the upward force on said piston exerted by said compressible spring thereby causing the piston to downwardly rotate through the central bore of the housing member.

7. The multipurpose drilling tool in accordance with claim 6, wherein said downwardly rotating piston is cycled to a drilling position by means of said piston travel guide.

8. The multipurpose drilling tool in accordance with claim 6, wherein said downwardly rotating piston is cycled to an underreaming position by means of said piston travel guide.

9. The multipurpose drilling tool in accordance with claim 8, wherein the piston graded land of said downwardly rotating piston contacts said blade graded lands of each of said blades, thereby causing said blades to pivot outwardly away from said housing member.

10. The multipurpose drilling tool in accordance with claim 7, wherein when the downward force on said piston is decreased to a pressure less than the upward force exerted on said piston by the compressible spring, the piston is cycled upwardly from the drilling position to a relaxed position.

11. The multipurpose drilling tool in accordance with claim 8, wherein when the downward force on said piston is decreased to a pressure less than the upward force exerted on said piston by the compressible spring, the piston is cycled upwardly from the underreaming. A multipurpose axed position.

12. A multipurpose drilling tool in accordance with claim 1, wherein said plurality of tattle ports are in fluid communication with said lower section of said central bore.

13. A multipurpose drilling tool capable of cycling from a relaxed position to either a drilling position or an underreaming position comprising:

a housing member comprising an upper inlet end, a lower outlet end, a central bore having at least an upper section and a lower section disposed within said housing and connecting said inlet end and outlet end, and a plurality of tattle tale ports for indicating the pressure differential $\delta P$ between differing pump pressures through said tattle tale ports;

a hollow piston disposed within said upper section of said central bore, said piston having a piston graded land, a central piston bore having an upper end and a plurality of ancillary ports;

a compressible spring disposed within said lower section of said central bore and exerting an upward force on said piston;

a plurality of underreaming blades pivotally mounted to said housing member each of said blades comprising at least one cutting surface and a blade graded land configured in such a manner that said blades pivot outwardly from said housing member upon contact with said graded piston land;

a pair of piston hold down screws fixedly mounted within said housing and projecting into said central bore of said housing;

a piston travel guide etched or cut into the outer surface of said piston and engaging said pair of piston hold down screws in order to cycle said piston through said central bore to either a drilling position or an underreamining position;

means for attaching a drill bit to said housing member; and means for attaching said housing member to a drill string.

14. The multipurpose drilling tool in accordance with claim 13, wherein said upper end of said central piston bore is in fluid communication with a top piston orifice and said plurality of ancillary ports include an upper tool flush, a lower tool flush, four circumferentially spaced blade cleaning jets, a tattle tale orifice and four circumferentially spaced tattle tale piston fluid ports.

15. The multipurpose drilling tool in accordance with claim 13, wherein the introduction of drilling fluid into the upper inlet end of said housing member exerts a downward force on said piston in excess of the upward force on said piston exerted by said compressible spring thereby causing the piston to downwardly rotate through the central bore of the housing member.

16. The multipurpose drilling tool in accordance with claim 15, wherein said downwardly rotating piston is cycled to a drilling position by means of said piston travel guide.

17. The multipurpose drilling tool in accordance with claim 15, wherein said downwardly rotating piston is cycled to an underreaming position by means of said piston travel guide.

18. The multipurpose drilling tool in accordance with claim 17, wherein the piston graded land of said downwardly rotating piston contacts said blade graded lands of each of said blades, thereby causing said blades to pivot outwardly away from said housing member.

19. The multipurpose drilling tool in accordance with claim 16, wherein when the downward force on said piston is decreased to a pressure less than the upward force exerted on said piston by the compressible spring, the piston is cycled upwardly from the drilling position to a relaxed position.

20. The multipurpose drilling tool in accordance with claim 17, wherein when the downward force on said piston is decreased to a pressure less than the upward force exerted on said piston by the compressible spring, the piston is cycled upwardly from the underreaming position to a relaxed position.

* * * * *